United States Patent [19]

Hetrick

[11] 4,166,581

[45] Sep. 4, 1979

[54] SPREADER FOR PARTICULATE MATERIAL

[75] Inventor: Vernon L. Hetrick, Fairview Park, Ohio

[73] Assignee: Meyer Products, Inc., Cleveland, Ohio

[21] Appl. No.: 874,806

[22] Filed: Feb. 3, 1978

[51] Int. Cl.[2] ..... E01C 19/20

[52] U.S. Cl. ..... 239/683; 222/237; 239/687; 251/77; 291/38

[58] Field of Search ..... 222/237, 240, 242; 214/17 CB; 291/1, 3, 23, 32, 38; 251/77; 239/661, 665, 666, 681, 683, 684, 687

[56] References Cited

U.S. PATENT DOCUMENTS

| | | | |
|---|---|---|---|
| 460,120 | 9/1891 | Eberhart | 239/683 |
| 3,374,956 | 3/1968 | Bazilli et al. | 239/683 |
| 3,512,721 | 5/1970 | Barlow et al. | 239/684 X |

*Primary Examiner*—John J. Love
*Assistant Examiner*—Andres Kashnikow
*Attorney, Agent, or Firm*—Meyer, Tilberry & Body

[57] ABSTRACT

In a spreader of the type used for spreading particulate material onto a roadway and comprising an upper hopper having a lower material discharge chamber terminating in a lower discharge opening, a rotatable spreader element below the discharge opening and a valve mechanism between the discharge chamber and the spreader element for controlling flow of material from the chamber to the spreader, there is provided an arrangement for shifting the valve mechanism between an opened and closed position in response to the direction of rotation of the spreader element. When the spreader element is rotating in one direction, the valve mechanism is automatically opened. When the spreader is rotated in the opposite direction the valve mechanism is automatically closed. This valve operating feature is accomplished by transmitting force through the particulate material within the discharge chamber of the spreader device so that no physical connection is provided between the motor and the valve shifting arrangement.

23 Claims, 11 Drawing Figures

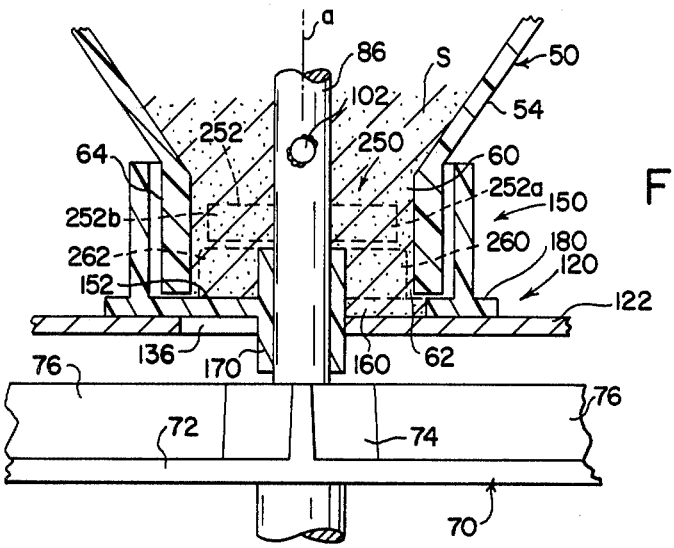
FIG. 9
FIG. 10
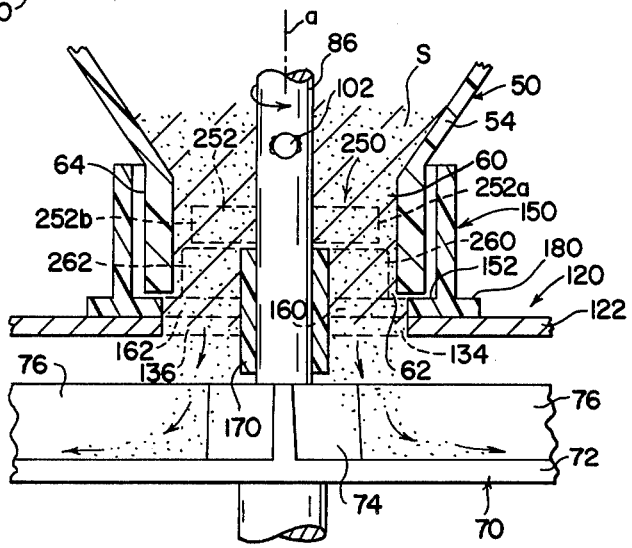
FIG. 11
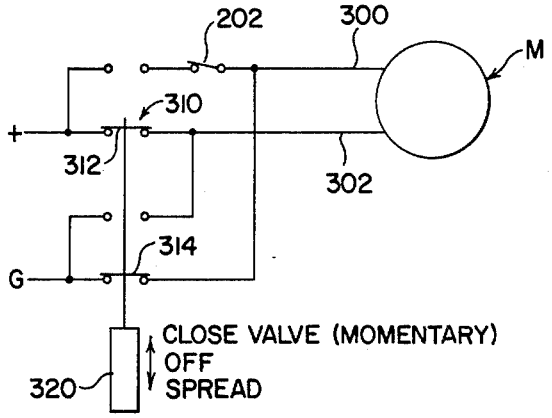

SPREADER FOR PARTICULATE MATERIAL

This invention relates to the art of spreading particulate material and more particularly to an improved spreader for such material.

BACKGROUND OF THE INVENTION

It has become common practice to mount a spreader upon a vehicle for spreading particulate material, such as salt and cinders, onto a roadway being travelled by the vehicle. One of the more common spreaders employs a hopper having a lower discharge opening through which the particulate material falls onto a rotating spreader element, known as a broadcast spreader. By rotating the spreader element as material is being discharged onto the element, the particulate material is centrifugally propelled by the spreader element in a wide pattern onto the roadway. In more recent designs of this type of device, a motor is mounted on the spreader and below the rotating spreader element for directly rotating the spreader element. In some instances, the spreader element is supported on a motor driven shaft which protrudes upwardly into the hopper. This shaft includes outwardly extending members which are used to break up large agglomerations of material and to agitate the material for better feeding through the discharge opening. In some instances, this type of material spreader includes a valving mechanism between the discharge chamber and lower spreader element. When not in use, the valving mechanism is often closed. When in use, the valving mechanism is opened to allow discharge of material through the discharge opening and onto the broadcast spreader. Such a mechanism is illustrated in U.S. Pat. No. 3,374,956, which is incorporated by reference for background information. A spreader structure as illustrated in the above-mentioned patent presents some difficulties in that the valving mechanism must be closed by external mechanisms, such as rods, cables, links, etc., which can become clogged with snow and ice during use of the spreader. The adjustment of externally manipulated elements is critical, especially when the hopper is movable with respect to the supporting vehicle. In addition, external control devices require more time to assemble onto a vehicle and require adjustments of the valve moving elements for accurate control of the valving mechanism.

THE INVENTION

The present invention relates to an improvement in a spreader of the general type illustrated in U.S. Pat. No. 3,374,965 and more particularly to an improved spreader device which employs an automatic valving arrangement for controlling the valving between the discharge chamber and the rotating spreader element. In accordance with this invention, there is provided an improved arrangement for shifting the valving mechanism between the opened and closed position. In accordance with this improvement, the shifting means includes a driven coupling member in the discharge chamber and secured to a first valve member, a driving coupling member rotatably mounted in the chamber, means for spacing the coupling members in the chamber to create a driving force through the particulate material in the chamber and between the coupling members as the driving coupling member is rotated, means responsive to the motor means used to drive the spreader element for rotating the driving coupling member in a first direction creating a force on the driven coupling member tending to move the driven coupling member and the first valve member into the valve opened position, means responsive to the motor means rotating in a second direction opposite to the first direction for rotating the driving coupling member in a second direction creating a force on the driven coupling member tending to move the driven coupling member and the first valve element into a valve closed position and means for selectively changing the direction of rotation of the motor means. In this manner, the motor can be driven in the material spreading direction which automatically opens the valving mechanism between the discharge opening and the rotating spreader element. When it is desirable to discontinue the spreading operation, the motor driving the spreader element may be reversed. In this manner, the valving mechanism is automatically closed to prevent inadvertent discharge of particulate material from the hopper during periods of inactivity of the spreader.

In accordance with the invention, the particulate material within the discharge chamber of the hopper is used as a motivating force between the elements which open and close the valve. This concept does not require complicated mechanisms. The relatively expensive assembly and manufacturing techniques required by other arrangements used in opening and closing the valving between the discharge chamber and the rotating spreader of a device as described above are not necessary when using the present invention. U.S. Pat. No. 3,512,721 illustrates a centrifugally operated valving arrangement for a material spreader. However, this arrangement does not incorporate a valving mechanism responsive to the direction of movement of the driving motor or a mechanism for opening and closing the valving of a particulate material spreader by a fluid coupling-like using the particulate material itself as the transmitting media.

The primary object of the present invention is the provision of a particulate material spreader having a valving mechanism, which valving mechanism is responsive to the direction of rotation of the spreader element or the motor driving the spreader element.

Another object of the present invention is the provision of a particulate material spreader having a valving mechanism, which valving mechanism uses the material in the spreader in a fluid coupling-like arrangement to open and close the valving mechanism.

Still a further object of the present invention is the provision of a particulate material spreader, which spreader has an automatic stopping mechanism that is shiftable between an open and closed position without requiring externally manipulated levers, cables, rods or the like.

Yet another object of the present invention is the provision of a particulate material spreader as defined above, which spreader includes a valving mechanism which can be used on various vehicles without requiring external operating implements.

BRIEF DESCRIPTION OF DRAWINGS

In the specification there are included the following drawings:

FIGS. 9 and 10 are further views of the operating characteristics of the preferred embodiment of the present invention; and, FIG. 11 is a schematic wiring diagram of the circuit employed in the preferred embodiment of the invention.

PREFERRED EMBODIMENT

Figure 1:
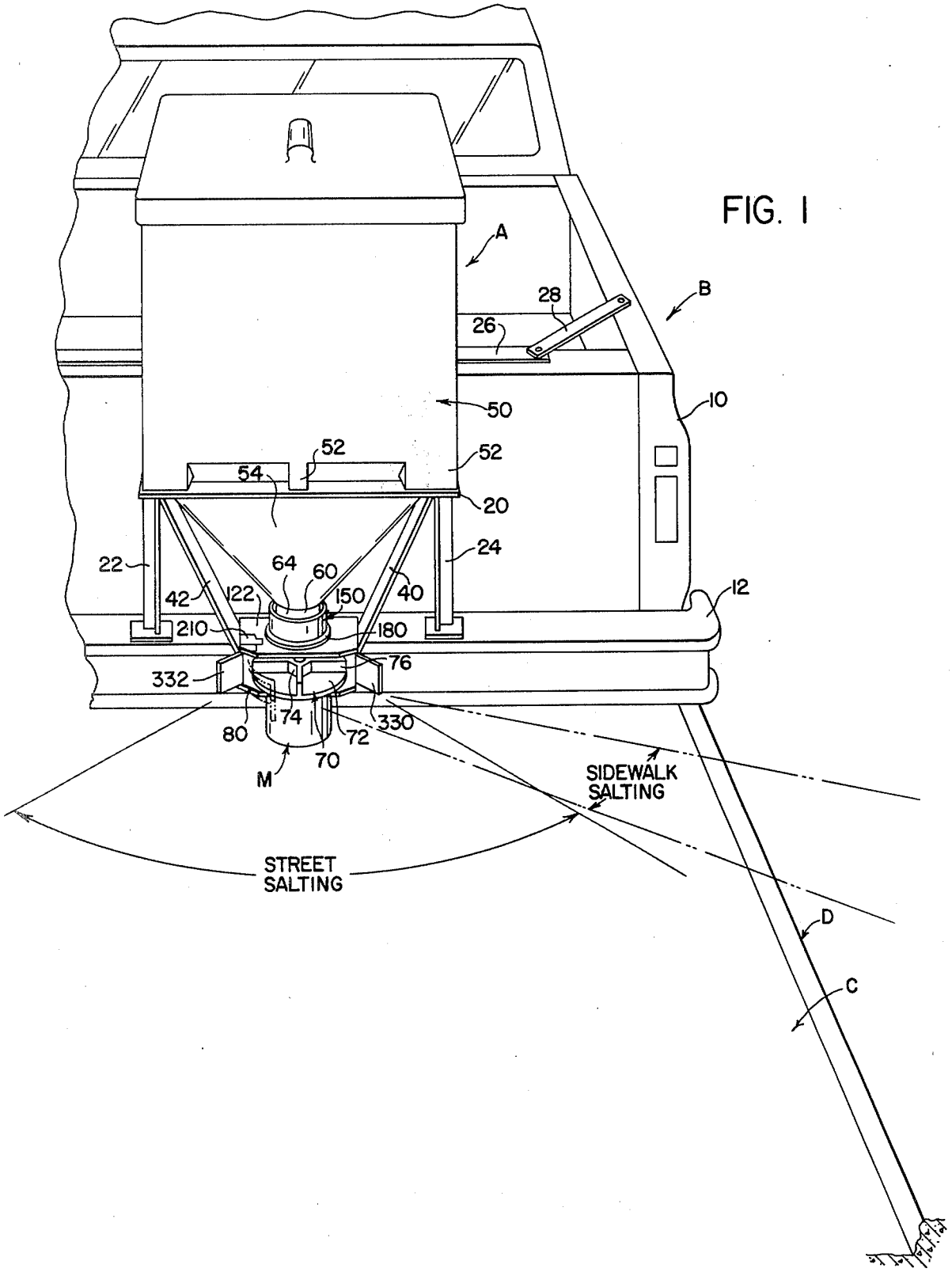
FIG. 1 is a pictorial view illustrating a preferred embodiment of the present invention.
Figure 2:
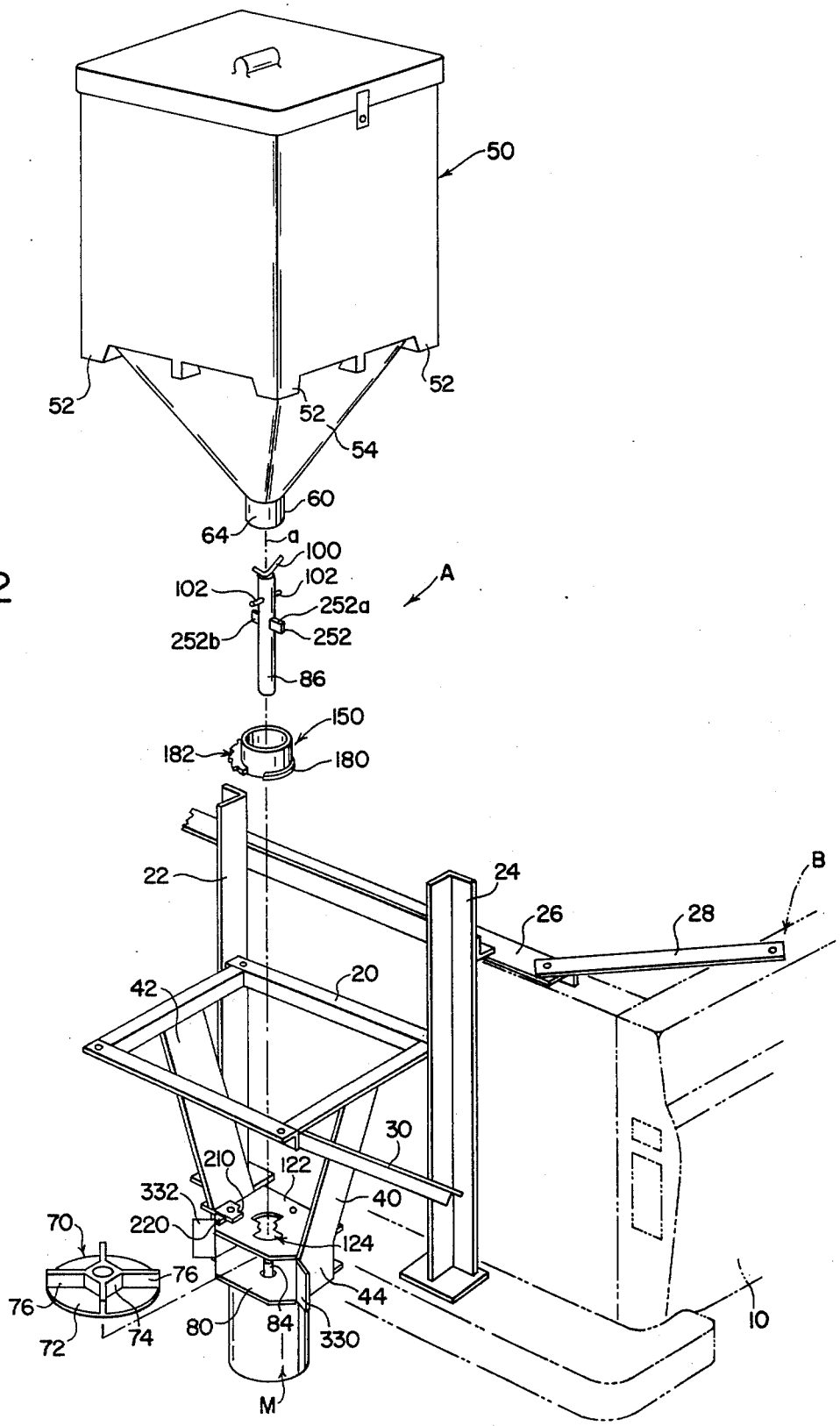
FIG. 2 is a somewhat exploded, pictorial view showing the embodiment illustrated in FIG. 1.

Referring now to the drawings wherein the showings are for the purpose of illustrating a preferred embodiment of the invention only, and not for the purpose of limiting same, spreader A is mountable upon a motor vehicle B for spreading particulate material, such as salt or cinders, onto a roadway C. For illustrative purposes, roadway C terminates in a parallel curb D separating the roadway from a pedestrian walkway. In accordance with standard practice, vehicle B includes a bed 10 having a rear bumper 12. The illustrated vehicle does not have a dump bed; however, the spreader A could be appropriately mounted onto a dump bed vehicle without changes beyond those well within the general skill in the art of material spreaders. In accordance with the illustrated embodiment, an appropriate mounting structure is provided on vehicle B for supporting the spreader A. This mounting structure includes a platform 20 supported upon generally parallel, vertically extending pillars 22, 24. These pillars are affixed onto bed 10 by a transversely extending brace 26 and outboard struts 28, only one of which is shown in FIGS. 1 and 2. Platform 20 is held in a generally horizontal plane by spaced struts 30, only one of which is shown in FIG. 2. Angled hangers 40, 42 diverge downwardly and inwardly and terminate in vertically straight portions 44, 46, respectively. The hangers are used to secure the valving mechanism and drive mechanism for spreader A in operable relationship with an upper hopper 50, which receives particulate material to be distributed from spreader A. Hopper 50 has a somewhat standard design and is constructed to provide an appropriate receptacle for particulate material and an arrangement for directing the particulate material toward the rotating spreading element of spreader A. In the illustrated embodiment of the invention the hopper is formed into a generally square upper box portion having peripherally spaced support lugs 52 which rest upon platform 20. Bolts extending through the platform are received in at least selected lugs 52 for proper location and support of hopper 50 with respect to the remainder of the mechanisms and structures comprising the spreader A. Hopper 50 includes a tapered bottom chute 54 terminating in a generally cylindrical discharge chamber 60 having a lower generally circular discharge opening 62 and an outer cylindrical wall 64. As material is placed within the hopper 50, it is fed through the tapered chute 54 to the cylindrical discharge chamber 60 from which it can be discharged from lower opening 62. Since hopper 50 is supported on platform 20, the position of lower cylindrical chamber 60 is fixed by the supporting platform and the mechanism for securing hopper 50 onto this platform.

Below discharge opening 62 there is provided a rotatable spreader element 70 which may take a variety of structural forms. In the illustrated embodiment, spreader element 70 includes a lower circular plate 72, a center hub 74 and four evenly spaced, radially extending vanes 76. A generally fixed, mounting plate 80, best shown in FIGS. 2 and 3, includes an opening 82 generally concentric with discharge opening 62 and outer cylindrical surface 64. Motor M is secured onto the lower surface of mounting plate 80 so that the motor drive shaft 84 extends along a vertical axis a through opening 82. A shaft extension 86 is secured onto drive shaft 84 by an appropriate coupling sleeve 88 and a set screw 90. The upper portion of shaft extension 86 is provided with an L-shaped agitator 100 and two transversely extending agitators 102. As so far explained, material to be spread is placed within hopper 50 and motor M rotates in a first direction. This causes the agitators 100, 102 to rotate in the particulate material and cause the material to flow through opening 62 onto the rotating spreader element 70. From the spreader element, the particulate material is centrifugally propelled outwardly onto the roadway along which vehicle B is travelling. As so far explained, spreader A is somewhat standard in design and operation.

Figure 3:
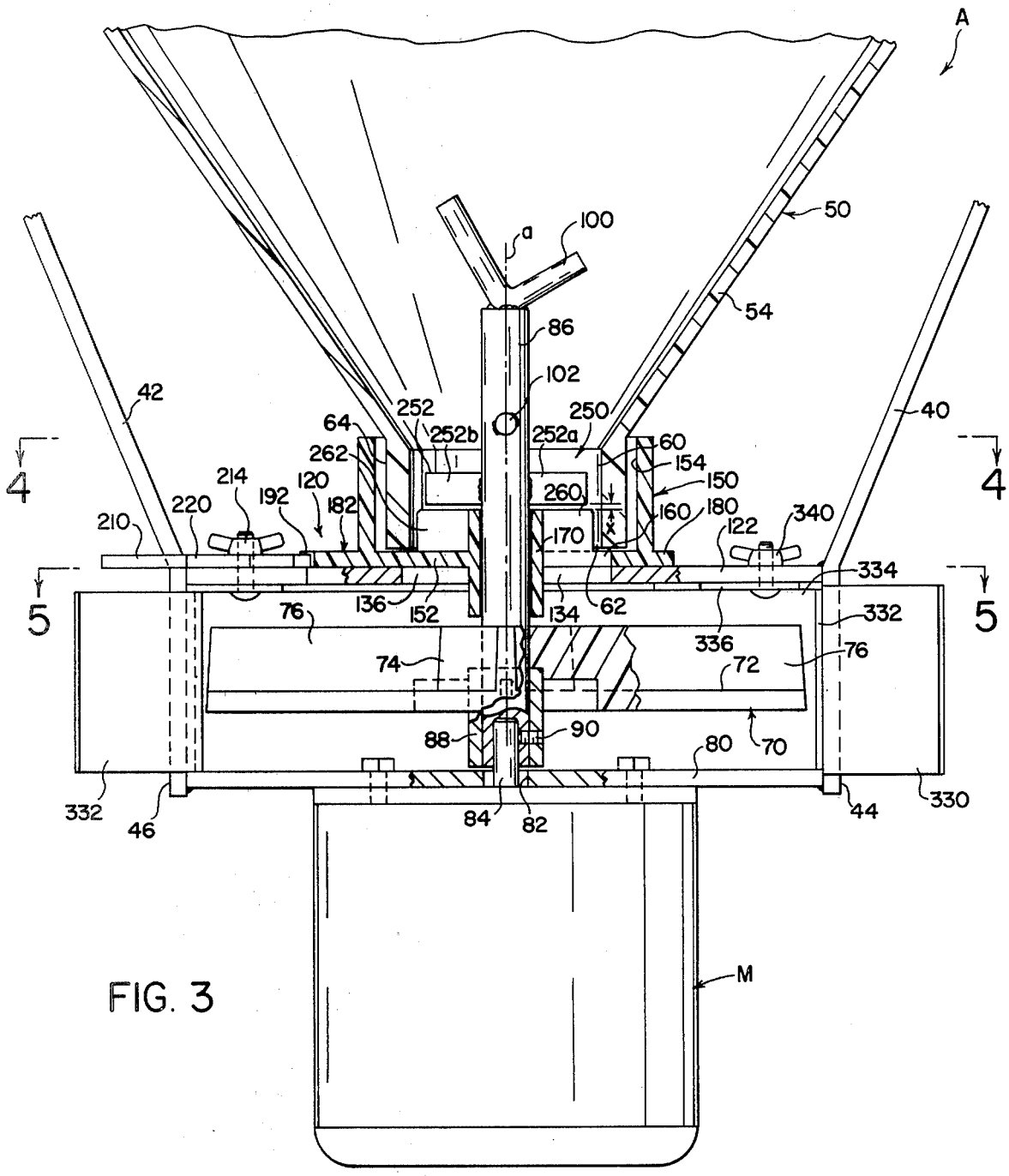
FIG. 3 is an enlarged, partial cross-sectional view showing certain details of the preferred embodiment of the invention.
Figure 4:
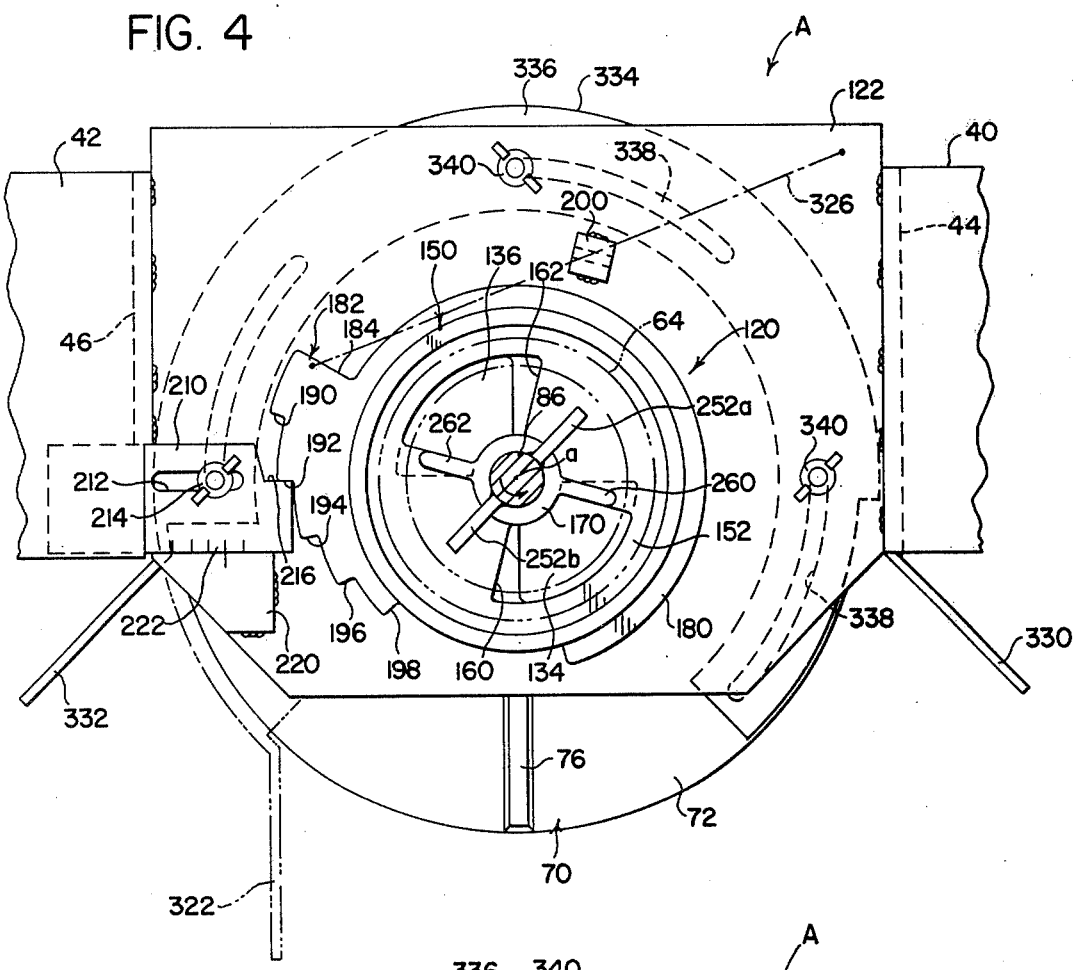
FIG. 4 is an enlarged, top view taken generally along line 4—4 of FIG. 3.
Figure 5:
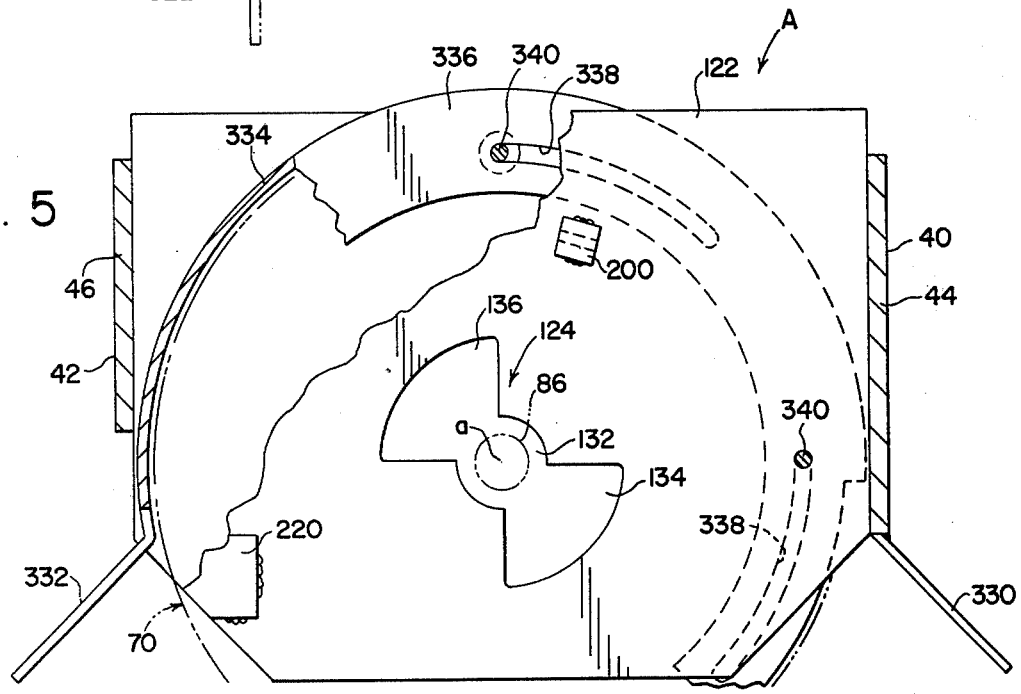
FIG. 5 is a partial view with cut away portions taken generally along line 5—5 of FIG. 3.

In some instances, a spreader of the type described above includes a valving mechanism for opening and closing the passage between discharge chamber 60 and rotating spreader element 70. In the preferred embodiment of the invention there is provided a valving mechanism 120 having a fixed valve plate 122 with a generally butterfly-shaped opening 124 including a central shaft clearance portion 132 and fan-shaped valve openings 134, 136, as best shown in FIGS. 4 and 5. In accordance with the present invention, there is provided a rotatable valve member 150 shown pictorially in FIG. 2 and in cross-section in FIG. 3. The top view of valve member 150 is best illustrated in FIG. 4. In accordance with the preferred embodiment, valve member 150, which is rotatable, has a lower generally flat plate 152 slidably received upon the upper surface of fixed valve plate 122. Of course, an appropriate lubricant could be provided between these two elements. In addition, the upper surface of lower plate 152 is spaced below the terminal end of chamber 60 as best shown in FIG. 3. In other words, member 150 can rotate about axis a while retaining surface 154 of valve member 150 generally concentric with outer cylindrical surface 64 of chamber 60. Within the lower plate 152 there are provided transversely spaced valve openings 160, 162 which generally match the shape of portions 134, 136 of opening 124. Valve member 150 includes a central journal hub 170 rotatably mounted about shaft extension 86. In this manner, shaft extension 86 retains the concentric relationship of arcuately movable valve member 150 without exerting a driving force of any sufficient magnitude on the member as the extension is rotated by motor M. As can be seen, there is spacing between cylindrical surface 154 and surface 64 and spacing between the lower portion of chamber 60 and the upper surface of lower plate 152. Thus, the spacing between hopper 50 and the lower driving and valving mechanisms is not required to be a close machine set.

Figure 6:
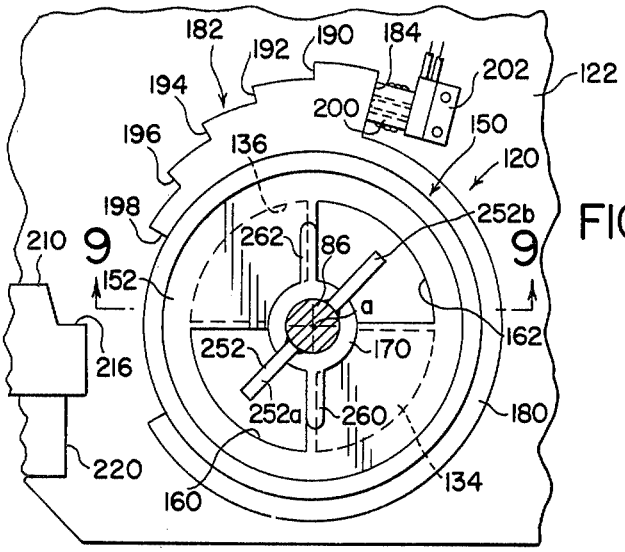
FIGS. 6, 7 and 8 are schematic views showing operating characteristics of the preferred embodiment of the invention.

To limit the opened and closed positions between valve member 150 and fixed valve plate 122, there is provided a rim 180 extending circumferentially around the lower portion of movable valve member 150. This rim includes an abutment member 182 having a closed stop shoulder 184 and stepped opened shoulders 190–198. The shoulders 190–198, are spaced circumferentially around valve member 150 to control the angular movement of the valve member to adjust the amount of discharge through the valving mechanism 120 when valve member 150 is shifted into the fully opened position. The openings in the fixed valve plate 122 and the lower plate 152 of valve member 150 are such that the adjustment of the opened position by abutments or shoulders 190–198 changes the effect opening through which the particulate material flows when the valve member 150 is in the fully opened position. To control the closed position there is provided a fixed stop 200. As arcuately movable member 150 is moved to the closed position, as shown in FIG. 6, shoulder 184 engages stop 200 to place the openings in plates 122 and 152 in the closed position without access between the discharge chamber and spreader element 70. For a purpose to be explained later, a limit switch 202 is employed with abutment 200 to provide a switch actuation when shoulder 84 engages the valve closed stop 200. Any appropriate limit switch may be employed, such as a plunger actuated limit switch. Indeed, the limit switch may be mounted upon stop 200 without extending through the stop.

To determine the opened position of valve plates 122, 152 there is provided a movable valve opened stop 210 in the form of a movable plate having a slot 212 coacting with a wing nut 214 and supported on fixed plate 122. A shoulder 216 is movable inwardly by changing the position of the stop 210 to engage a different one of the abutments or shoulders 190–198. To rigidify movable valve opened stop 210, there is provided a fixed abutment 220. Indicia on the upper surface of abutment 220 coacts with corresponding indicia on the stop 210 to determine which of shoulders 190–198 will be engaged by shoulder 216 when the valve mechanism is opened.

Figure 7:
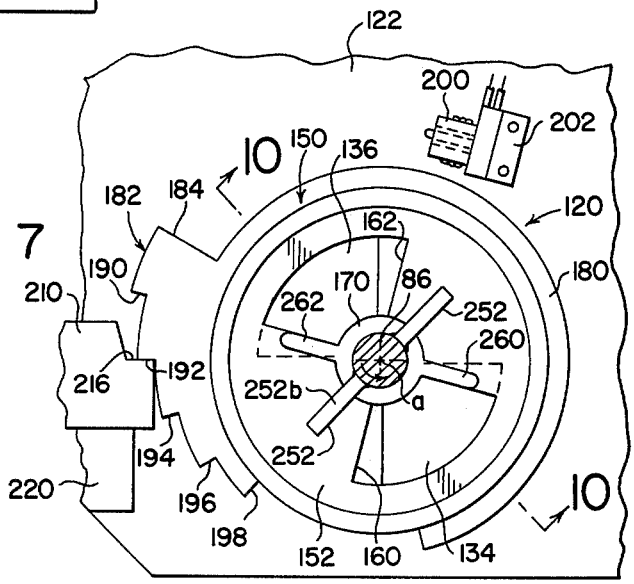

In operation of the illustrated embodiment so far described, valve member 150 is rotatably mounted on shaft extension 86 and is movable selectively between a valve closed position with shoulder 184 engaging stop 200 as shown in FIG. 6 and a valve opened position with one of the shoulders 190–198 engaging abutment or shoulder 216 on stop 210, as shown in FIG. 7. The particular stop shoulder 190–198 being employed in the valve opened position determines the amount of register between valve openings 134, 136 and valve openings 160, 162. Thus, according to the position of stop 120, the amount of material passing through valving mechanism 120 is controlled by the inward position of stop 210.

In accordance with the present invention there is provided a novel arrangement for driving the movable valve member 150 with respect to valve plate 122 between the closed position, as shown in FIG. 6, and the opened position, as shown in FIG. 7. In accordance with this novel feature, as best shown in FIGS. 3, 4, 9 and 10, a fluid coupling-like arrangement 250 is provided for driving valve member 150 in either direction, in accordance with the rotation of shaft extension 86 by motor M. In the illustrated embodiment, the shaft extension is secured onto lower rotating spreader element 70 so that these components are driven in unison by motor M. Fluid coupling-like arrangement 250, in accordance with the preferred embodiment of the invention, uses the particulate material S in chamber 60 for creating motion or force components acting against valve member 150. In this manner the valve member is positively shifted between the opened and closed positions according to the motion or force components created within material S of chamber 60 as motor M rotates shaft extension 86 in either of two rotational directions. In accordance with the preferred embodiment the fluid coupling-like arrangement employing the material S includes an upper impeller 252 mounted on and rotatable by shaft extension 86. Impeller 252 includes two diametrically opposed, radially extending generally flat vanes **252*a*, 252*b*. These vanes may have a variety of shapes; however, in practice, generally flat vanes have proven satisfactory. Impeller 252 is continuously rotated by motor M during the material spreading operation. This impeller coacts with the agitators 100, 102 to crumble any agglomerated particulate material and to drive the material downwardly through chamber 60 and out opening 62 through the valving mechanism 120. Extending upwardly from plate 152 of valve member 150 and extending from the central hub 170 there are provided radially extending, generally flat vanes 260, 262. These vanes are located just below the rotating impeller 252 so that there is a slight amount of clearance between the continuously rotating impeller 252 and the upper edges of vanes 260, 262. As motor M drives the spreader element 70 in the spreading operation, a force component is created by the continuously rotating impeller 252, which force component exerts a force upon vanes 260, 262 in a direction driving rotatable valve element 150 into the valve opened position, as shown in FIG. 7. Impeller 152 is rotating in accordance with the direction of the arrow during this operation. After reaching the valve opened position determined by stop 210, further rotation of impeller 252 during the spreading operation of element 70 has no further effect upon valve member 150, except to hold the valve member in the opened position so that there is an opening between the valve plates determined by the inward disposition of stop 210. The spreading function is illustrated further in FIG. 10. Material S is discharged through the openings between the valve plates onto plate 72 of spreader element 70**. From there, the material is propelled outwardly into a path which may be restricted in accordance with another apsect of the preferred embodiment to be explained later.

Figure 8:
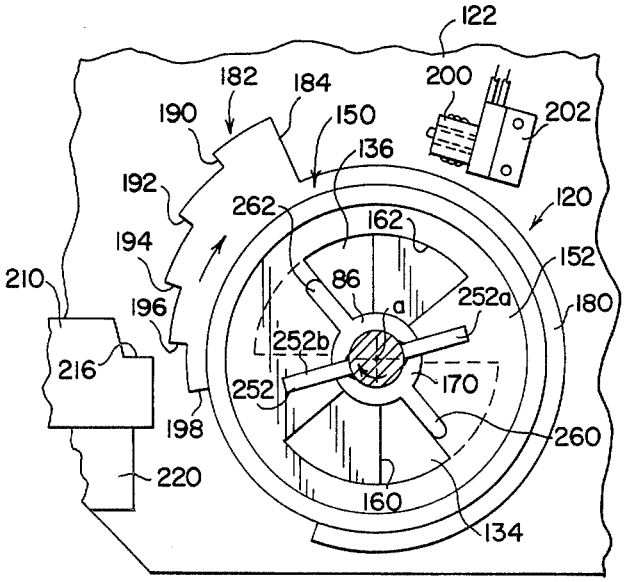

When it is desired to close the openings between valve plate 122 and valve member 150, motor M is reversed so that it rotates in a second mode opposite to the first mode. This is illustrated in FIG. 8. When this happens, shaft extension 86 is rotated in accordance with the arrow which causes a driving force to be exerted by material S between rotating impeller 252 and upwardly extending vanes 260, 262. This causes rotatable valve member 150 to rotate in the direction of the arrow in FIG. 8 toward stop 200. The access openings between valve plate 122 and valve plate 152 of member 150 are then closed. As the motor continues to rotate in a direction opposite to the spreading direction, shoulder 184 engages stop 220, as shown in FIG. 6. This energizes switch 202 to discontinue the operation of the motor. Valve member 150 is now in the closed position and remains in the closed position until the spreader is again operated in the spreading mode. In that instance, valve member 150 is rotated in the direction indicated in FIG. 7 to again open the valving mechanism to the extent determined by movable stop 210.

Referring now to the wiring diagram shown in FIG. 11, there is provided an arrangement for reversing the direction of motor M between the spreading operation and the valve closing operation. In this diagram, the polarity of input leads 300, 302 controls the direction of motor M which is an electric motor in this embodiment. A switch 310 with contacts 312, 314 is movable into three positions by an appropriate selective operator 320 which can be mounted in the cab of vehicle B. When operator 320 is in the position shown in FIG. 11, motor M is driven in the first directional mode which causes spreading in accordance with the previous description. By shifting operator 320 into the "CLOSE VALVE" position wherein switch contacts 312, 314 are shifted to the other electrical connections, motor M is reversed and valve member 150 is shifted into the closed position. At this time, limit switch 202 is opened to discontinue the operation of motor M. Thereafter, operator 320 can be shifted into the "OFF" position awaiting the next spreading operation. Of course, without using limit switch 202 the motor M can be momentarily reversed to give a closing action for valve member 150. When the motor is driven in the spreading direction, impeller 252 opens the valve mechanism by rotating valve member 150. It is possible to provide a spring return schematically illustrated as dotted line 326 in FIG. 4. With this return, discontinuation of the operation of motor M will allow valve member 150 to return to the closed position because there is no opening force created in material S. This is not a preferred embodiment of the invention, but shows a slight modification thereof. In either instance, the valve is opened automatically by the fluid coupling-like arrangement including impeller 252.

As best illustrated in FIG. 1, the spreading angle for device A may be adjusted by including a fixed baffle 330 fixedly secured to vertical portion 44 of hanger 40 and a movable baffle 332. The movable baffle is incorporated with a cylindrical shield 334 having an upper arcuately shaped rim 336 with a plurality of circumferentially spaced slots 338. Wing nuts 340 extending through openings in plate 122 extend into circumferentially elongated slots 338 to adjust the position of movable baffle 332 while maintaining shield 334 in the desired position between the baffles 330, 332. By moving baffle 332 to the most restricted position, the pattern from spreader A covers the sidewalk beyond curb D. By shifting baffle 332 to the opened position as shown in FIG. 1, the spreading angle is adjusted to spread the particulate material over roadway C, as vehicle B moves therealong. Of course, other arrangements could be used for adjusting the throw angle and direction of spreader A.

Having thus defined the invention, it is claimed:

1. In a vehicle mounted device for spreading particulate material, said device comprising an upper hopper having a lower material discharge chamber terminating in a lower discharge opening a spreader element; motor means for rotating said spreader element about a generally vertical axis in a first rotational direction whereby material discharged from said opening onto said spreader element is centrifugally propelled from said element; and, valve means between said discharge chamber and said spreader element for controlling flow of said material from said chamber to said spreader element, said valve means having a first valve member, a second valve member and means for selectively shifting said valve members with respect to each other between a valve opened position allowing discharge of said material onto said spreader element and a valve closed position preventing discharge of said material onto said spreader element, the improvement comprising: said shifting means including a driven coupling member in said chamber and secured to said first valve member; a driving coupling member rotatably mounted in said chamber, means for spacing said coupling members in said chamber to create a driving force through particulate material in said chamber and between said coupling members as said driving coupling member is rotated, means responsive to said motor means rotating in said first rotational direction for rotating said driving coupling member in a first direction creating a force on said driven coupling member tending to move said driven coupling member and said first valve member into the valve opened position, means responsive to said motor means rotating in a second direction opposite to said first direction for rotating said driving coupling member in a second direction creating a force on said driven coupling member tending to move said driven coupling member and said first valve member into the valve closed position, and means for selectively changing the direction of rotation of said motor means.

2. The improvement as defined in claim 1 wherein said driven coupling member is at least one generally flat vane.

3. The improvement as defined in claim 2 wherein said one generally flat vane extends generally radially of said axis.

4. The improvement as defined in claim 3 wherein said driving coupling member is an impeller rotatable above said generally flat vane.

5. The improvement as defined in claim 4 wherein said impeller includes two radially outwardly extending impeller vanes.

6. The improvement as defined in claim 1 wherein said driving coupling member is an impeller rotatable above said driven coupling member.

7. The improvement as defined in claim 1 wherein said driving coupling member is fixed to said spreader element.

8. The improvement as defined in claim 1 including means for adjusting said valve opened position.

9. The improvement as defined in claim 8 wherein said adjusting means includes a generally fixed stop member coacting with a movable stop member on said first valve member for limiting said valve opened position of said first valve member and means for changing the relative position of said stop members to change the valve opened position of said first valve member.

10. The improvement as defined in claim 8 including means for stopping said motor means when said motor means is rotating in said second direction and said valve members are in said valve closed position.

11. The improvement as defined in claim 9 including means for stopping said motor means when said motor means is rotating in said second direction and said valve members are in said valve closed position.

12. The improvement as defined in claim 1 including means for stopping said motor means when said motor means is rotating in said second direction and said valve members are in said valve closed position.

13. In a vehicle mounted device for spreading particulate material, said device comprising an upper hopper having a lower material discharge chamber terminating in a lower discharge opening; a spreader element; motor means for rotating said spreader element about a generally vertical axis in a first rotational direction whereby material discharged from said opening onto said spreader element is centrifugally propelled from said element; and, valve means between said discharge chamber and said spreader element for controlling flow of said material from said chamber to said spreader element, said valve means having a first valve member, a second valve member and means for selectively shifting said valve members with respect to each other between a valve opened position allowing a discharge of said material onto said spreader element and a valve closed position preventing discharge of said material onto said spreader element, the improvement comprising: an impeller in said chamber and driven by said motor means, a driven element connected to said first valve member and located in said chamber, said driven element and impeller combining with material in said chamber to form a fluid coupling-like means for forcing said driven element in a valve opening direction when said motor means operates in a first direction mode to rotate said spreader element in said first direction and in a valve closing direction when said motor means rotates in a second direction mode opposite to said first direction mode, and means for selectively shifting said motor means between said direction modes.

14. The improvement as defined in claim 13 wherein said driven element is at least one generally flat vane.

15. The improvement as defined in claim 14 wherein said one generally flat vane extends generally radially of said axis.

16. The improvement as defined in claim 15 wherein said impeller rotates above said generally flat vane.

17. The improvement as defined in claim 16 wherein said impeller includes two radially outwardly extending impeller vanes.

18. The improvement as defined in claim 13 wherein said impeller includes two radially outwardly extending impeller vanes.

19. The improvement as defined in claim 13 wherein said impeller is rotatable above said driven element.

20. The improvement as defined in claim 13 wherein said impeller is fixed to said spreader element.

21. In a vehicle mounted device for spreading particulate material, said device comprising an upper hopper having a lower material discharge chamber terminating in a lower discharge opening; a spreader element; rotary drive means for rotating said spreader element about a generally vertical axis in a first rotational direction whereby material discharged from said opening onto said spreader element is centrifugally propelled from said element; and, valve means between said discharge chamber and said spreader element for controlling flow of said material from said chamber to said spreader element, said valve means having a first valve member, a second valve member and means for selectively shifting said valve members with respect to each other between a valve opened position allowing discharge of said material onto said spreader element and a valve closed position preventing discharge of said material onto said spreader element, the improvement comprising: said shifting means including rotatable means for creating a first motion component in particulate material in said chamber when said rotary drive means is rotated in said first rotational direction, said rotatable means including means for creating a second motion component in particulate material in said chamber when said rotary drive means is rotated in a second rotational direction opposite to said first direction, means responsive to said first motion component for shifting said valve members to said valve opened position, means responsive to said second motion component for shifting said valve member to said valve closed position, and means for selectively rotating said rotary drive means in said first or second rotational directions.

22. The improvement as defined in claim 21 wherein rotatable means includes an impeller rotatable about said vertical axis.

23. In a vehicle mounted device for spreading particulate material, said device comprising an upper hopper having a lower material discharge chamber terminating in a lower discharge opening; a spreader element; motor means for rotating said spreader element about a generally vertical axis in a first rotational direction whereby material discharged from said opening onto said spreader element is centrifugally propelled from said element; and, valve means between said discharge chamber and said spreader element for controlling flow of said material from said chamber to said spreader element, said valve means having a first valve member, a second valve member and means for selectively shifting said valve members with respect to each other between a valve opened position allowing discharge of said material onto said spreader element and a valve closed position preventing discharge of said material onto said spreader element, the improvement comprising: said shifting means including a driven coupling member in said chamber and secured to said first valve member; a driving coupling member rotatably mounted in said chamber, means for spacing said coupling members in said chamber to create a driving force through particulate material in said chamber and between said coupling members as said driving coupling member is rotated, means responsive to said motor means rotating in said first rotational direction for rotating said driving coupling member in a first direction creating a force on said driven coupling member tending to move said driven coupling member and said first member into the valve opened position, and means for moving said valve members into said valve closed position when said motor means is not rotating in said first direction.

* * * * *